United States Patent [19]

Irani et al.

[11] 4,356,250

[45] Oct. 26, 1982

[54] USE OF ZINC SALTS TO INCREASE DYE STABILITY

[75] Inventors: Nayyir F. Irani; Thomas O. Maier, both of Rochester, N.Y.

[73] Assignee: Eastman Kodak Company, Rochester, N.Y.

[21] Appl. No.: 224,415

[22] Filed: Jan. 12, 1981

[51] Int. Cl.[3] ..... G03C 5/54

[52] U.S. Cl. ..... 430/216; 430/223; 430/559; 430/551; 430/372; 430/237

[58] Field of Search ..... 430/216, 223, 559, 551, 430/372, 237

[56] References Cited

U.S. PATENT DOCUMENTS

| | | | |
|---|---|---|---|
| 2,788,274 | 4/1957 | Ranger | 430/372 |
| 3,081,167 | 5/1963 | Goulston | 96/29 |
| 3,196,014 | 7/1965 | Rogers | 96/29 |
| 3,249,432 | 5/1966 | Haas | 430/216 |
| 3,619,155 | 11/1971 | Young | 96/3 |
| 4,273,853 | 6/1981 | Ponticello et al. | 430/213 |

FOREIGN PATENT DOCUMENTS

| | | | |
|---|---|---|---|
| 1398286 | 6/1975 | United Kingdom | 430/372 |

OTHER PUBLICATIONS

Research Disclosure, Nov. 1976, pp. 75–87.
C.A. vol. 83, 1975, item 170956x.

*Primary Examiner*—John E. Kittle
*Assistant Examiner*—John L. Goodrow
*Attorney, Agent, or Firm*—Harold E. Cole

[57] ABSTRACT

Photographic elements, diffusion transfer assemblages and processes are described which employ redox dye-releasing materials and a zinc salt, such as zinc oxide, in such a form, location and concentration that it will be diffusible in the element during processing, and the dye which is released from the redox dye-releasing material during processing will have an increased stability to light exposure. The zinc salts may be incorporated in the photosensitive portion of a photosensitive element, a processing composition or a cover sheet.

32 Claims, No Drawings

USE OF ZINC SALTS TO INCREASE DYE STABILITY

This invention relates to photography, and more particularly to color diffusion transfer photography employing redox dye-releasing (RDR) materials and zinc salts to provide an increase in stability to light exposure of the dyes which are released from the RDR's.

U.S. Pat. No. 3,619,155 discloses the use of metal ions in various positions in a photographic film unit. These metal ions, however, are used to cross-link a polymeric layer which is located between the dye image-receiving layer and the adjacent silver halide emulsion layers. There is no disclosure in this patent that such metal ions will increase the dye stability (stability to light exposure) of a dye released from an RDR, or that zinc salts are particularly advantageous for this purpose.

British Pat. No. 1,398,286 relates to a light-reflecting layer containing zinc oxide or providing a reflecting layer adjacent to a layer containing zinc oxide. There is no disclosure in this patent, however, that the zinc oxide should be used in such a form, location and concentration so that it will be diffusible in the element during processing, or that it will increase the dye stability of a dye which is released from an RDR during processing.

U.S. Pat. Nos. 3,196,014 and 3,081,167 relate to the use of salts of such metals as copper and nickel in dye developer photographic film units. The dye developers form coordination complexes with the metals. There is no disclosure in these patents, however, that metal salts may be used to increase the dye stability of dyes released from RDR's without forming coordination complexes, or that zinc salts are particularly advantageous for increasing dye stability.

U.S. Pat. Application Ser. No. 025,686 of Ponticello et al relates to the use of metal salts in a particular mordant layer or a layer adjacent to the mordant layer to obtain improved dye stability. There is no disclosure in that patent application, however, of the use of zinc salts in the locations described herein to provide an increase in dye stability as described in this invention.

All photographic dyes to a greater or lesser degree are unstable to light. For optimum performance of any photographic system, it is desired to minimize this interaction. Although metal salts have been used in the art to improve dye stability, or stability to light exposure, there are disadvantages to using certain of these metal salts in particular locations. For example, when copper and nickel salts are incorporated directly into a mordant layer containing gelatin, a stain caused by the "biuret reaction" of these metals with gelatin is produced. Further, when zinc salts are added to certain mordant or dye image-receiving layers, a severe brittling or "mud-flat" cracking occurs. It is theorized that the zinc in that instance may be cross-linking the mordant to produce discontinuous cracks and valleys in the coating which are unacceptable. When zinc salts are added to the reflecting layer of titanium dioxide in an integral imaging receiver, an unexplainable loss in the time for the image to appear (access time) occurs, which is also unacceptable.

There is no indication in the art that zinc salts perform better than other metal salts for the uses described therein. We have found, as will be shown hereinafter, that zinc salts are unexpectedly better than other metal salts when used in the locations in a photographic element or film assemblage as described herein.

A photosensitive element in accordance with our invention comprises a support having thereon at least one silver halide emulsion layer having associated therewith a redox dye-releasing material, and wherein the photosensitive element contains a zinc salt in such a form, location and concentration that it will be diffusible in the element during processing, and the dye which is released from the redox dye-releasing material during processing will have an increased stability to light exposure.

We do not know the mechanism for improved dye stability in our invention. While the formation of metal chelates is often suggested as a mode of dye stabilization, we have found that the use of a zinc salt as described herein does not change the spectral characteristics of the released dye, which would usually happen if chelation occurred. Zinc salts introduced at various locations in an image transfer system, in accordance with our invention, show substantial benefits in improving dye stability, particularly for cyan azo dyes released from an RDR.

In our invention, it is believed that the zinc from the zinc salt in some form or another diffuses, within a period of time of upwards of two days or more, to the mordant layer containing the released dye, thus providing the increased dye stability. The use of these zinc salts in moderate concentrations has minor or no effect on sensitometry, dye hue, lateral dye diffusion (image smear) and raw stock keeping. The form in which these salts may be used so that they will be diffusible in the photographic element include, for example, solutions or surfactant-stabilized suspensions. Their use in the locations specified herein creates no unusual coating or physical problems.

Zinc salts as a class have an additional advantage over other metal salts because of the amphoteric nature of zinc. At the high pH used for processing, zinc salts will form the soluble zincate species, which is then free to migrate quickly to the mordant layer containing the released dye. Other metal salts which are not amphoteric would tend to be insoluble at the high pH used for processing, and thus not as much of them would diffuse to the mordant layer. As the pH is lowered in the element after processing, zinc ions will continue to diffuse as long as there are no significant quantities of insolubilizing anions present.

Zinc salts which may be used in accordance with our invention include, for example, zinc oxide, zinc acetate, zinc sulfate and zinc nitrate. In a preferred embodiment of our invention, zinc oxide is employed. Zinc oxide is inexpensive, available in a high degree of purity and is photographically inert. Zinc oxide offers the additional advantage of being coatable as a relatively insoluble species that would not be expected to migrate significantly within the coating structure until processing occurs.

The zinc salts employed in this invention may be employed at any concentration which is effective to provide an increase in the stability to light exposure of the released dye. In general, good results have been obtained when these zinc salts have been employed at a concentration or amount to provide a coverage of from about 10 to about 1200 mg/m$^2$ of photographic element. In a preferred embodiment, 100 to 600 mg/m$^2$ are employed.

The photosensitive element described above can be treated in any manner with an alkaline processing composition to effect or initiate development. A preferred method for applying processing composition is by use of a rupturable container or pod which contains the composition. In general, the processing composition employed in this invention contains the developing agent for development, although the composition could also just be an alkaline solution where the developer is incorporated in the photographic element, image-receiving element or process sheet, in which case the alkaline solution serves to activate the incorporated developer.

A photographic assemblage in accordance with this invention is adapted to be processed by an alkaline processing composition, and comprises:

(1) a photographic element as described above; and (2) a dye image-receiving layer.

In this embodiment, the processing composition may be inserted into the assemblage, such as by interjecting processing solution with communicating members similar to hypodermic syringes which are attached either to a camera or camera cartridge. The processing composition can also be applied by means of a swab or by dipping in a bath, if so desired. Another method of applying processing composition to a film assemblage which can be used in our invention is the liquid spreading means described in U.S. Application Ser. No. 143,230 of Columbus, filed Apr. 24, 1980.

In a preferred embodiment of the invention, the assemblage itself contains the alkaline processing composition and means containing same for discharge within the film unit. There can be employed, for example, a rupturable container which is adapted to be positioned during processing of the film unit so that a compressive force applied to the container by pressure-applying members, such as would be found in a camera designed for in-camera processing, will effect a discharge of the container's contents within the film unit. In this embodiment, either the photosensitive element or the processing composition may contain the zinc salt. When the zinc salt is located in the photosensitive element, it may be located anywhere in the photosensitive portion of the element, such as in a silver halide emulsion layer, an interlayer, an RDR layer, overcoat layer, etc. If the photosensitive element also contains a dye image-receiving layer, as will be described hereinafter, and adjacent light-reflecting and/or opaque layers, the zinc salt should not be located in these layers because of the disadvantages of these locations, as discussed above.

The redox dye-releasing (RDR) materials or compounds useful in our invention are well known to those skilled in the art and are, generally speaking, ballasted compounds which will react with oxidized or unoxidized developing agent or electron transfer agent to release a dye. Such nondiffusible RDR's include positive-working compounds, as described in U.S. Pat. Nos. 3,980,479; 4,139,379; 4,139,389; 4,199,354 and 4,199,355, the disclosures of which are hereby incorporated by reference. Such nondiffusible RDR's also include negative-working compounds, as described in U.S. Pat. Nos. 3,728,113 of Becker et al; 3,725,062 of Anderson and Lum; 3,698,897 of Gompf and Lum; 3,628,952 of Puschel et al; 3,443,939 and 3,443,940 of Bloom et al; 4,053,312 of Fleckenstein; 4,076,529 of Fleckenstein et al; 4,055,428 of Koyama et al; German Pat. Nos. 2,505,248 and 2,729,820; *Research Disclosure* 15157, November, 1976 and *Research Disclosure* 15654, April, 1977, the disclosures of which are hereby incorporated by reference.

In a preferred embodiment of our invention, the dye-releasers such as those in the Fleckenstein et al patent referred to above are employed. Such compounds are ballasted sulfonamido compounds which are alkali-cleavable upon oxidation to release a diffusible dye from the nucleus and have the formula:

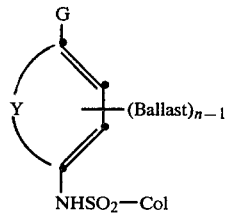

wherein:

(a) Col is a dye or dye precursor moiety;

(b) Ballast is an organic ballasting radical of such molecular size and configuration (e.g., simple organic groups or polymeric groups) as to render the compound nondiffusible in the photosensitive element during development in an alkaline processing composition;

(c) G or $OR_2$ or $NHR_3$ wherein $R_2$ is hydrogen or a hydrolyzable moiety and $R_3$ is hydrogen or a substituted or unsubstituted alkyl group of 1 to 22 carbon atoms, such as methyl, ethyl, hydroxyethyl, propyl, butyl, secondary butyl, tertiary butyl, cyclopropyl, 4-chlorobutyl, cyclobutyl, 4-nitroamyl, hexyl, cyclohexyl, octyl, decyl, octadecyl, docosyl, benzyl or phenethyl (when $R_3$ is an alkyl group of greater than 6 carbon atoms, it can serve as a partial or sole Ballast group);

(d) Y represents the atoms necessary to complete a benzene nucleus, a naphthalene nucleus or a 5- to 7-membered heterocyclic ring such as pyrazolone or pyrimidine; and (e) n is a positive integer or 1 to 2 and is 2 when G is $OR_2$ or when $R_3$ is a hydrogen or an alkyl group of less than 8 carbon atoms.

For further details concerning the above-described sulfonamido compounds and specific examples of same, reference is made to the above-mentioned Fleckenstein et al U.S. Pat. No. 4,076,529 referred to above.

In another preferred embodiment of our invention, positive-working, nondiffusible RDR's of the type disclosed in U.S. Pat. Nos. 4,139,379 and 4,139,389 are employed. In this embodiment, an immobile compound is employed which as incorporated in a photographic element is incapable of releasing a diffusible dye. However, during photographic processing under alkaline conditions, the compound is capable of accepting at least one electron (i.e., being reduced) and thereafter releases a diffusible dye. These immobile compounds are ballasted electron accepting nucleophilic displacement compounds.

The dye image-receiving layer in the above-described film assemblage is optionally located on a separate support adapted to be superposed on the photographic element after exposure thereof. Such image-receiving elements are generally disclosed, for example, in U.S. Pat. No. 3,362,819. When the means for discharging the processing composition is a rupturable container, it is usually positioned in relation to the photographic element and the image-receiving element so that a compressive force applied to the container by pressure-applying members, such as would be found in a typical camera used for in-camera processing, will effect a discharge of the container's contents between the image-receiving element and the outermost layer of the photographic element. After processing, the dye image-receiving element is separated from the photographic element.

The dye image-receiving layer in the above-described film assemblage in another embodiment is located integrally with the photographic element between the support and the lowermost photosensitive silver halide emulsion layer. One useful format for integral receiver-negative photographic elements is disclosed in Belgian Pat. No. 757,960. In such an embodiment, the support for the photographic element is transparent and is coated with an image-receiving layer, a substantially opaque light-reflective layer, e.g., $TiO_2$, and then the photosensitive layer or layers described above. After exposure of the photographic element, a rupturable container containing an alkaline processing composition and an opaque process sheet are brought into superposed position. Pressure-applying members in the camera rupture the container and spread processing composition over the photographic element as the film unit is withdrawn from the camera. The processing composition develops each exposed silver halide emulsion layer, and dye images, formed as a function of development, diffuse to the image-receiving layer (along with zinc in some form) to provide a positive, right-reading image which is viewed through the transparent support on the opaque reflecting layer background. For other details concerning the format of this particular integral film unit, reference is made to the above-mentioned Belgian Pat. No. 757,960.

Another format for integral negative-receiver photographic elements in which the present invention is useful is disclosed in Canadian Pat. No. 928,559. In this embodiment, the support for the photographic element is transparent and is coated with the image-receiving layer, a substantially opaque, light-reflective layer and the photosensitive layer or layers described above. A rupturable container, containing an alkaline processing composition and an opacifier, is positioned between the top layer and a transparent cover sheet which has thereon, in sequence, a neutralizing layer, and a timing layer. In this embodiment, either the photosensitive portion of the photosensitive element or the transparent cover sheet or the rupturable container contains the zinc salt in such a form, location and concentration that it will be diffusible in the element during processing, so that at least one of the dyes released from an RDR during processing will have an increased stability to light exposure. The film unit is placed in a camera, exposed through the transparent cover sheet and then passed through a pair of pressure-applying members in the camera as it is being removed therefrom. The pressure-applying members rupture the container and spread processing composition and opacifier over the negative portion of the film unit to render it light-insensitive. The processing composition develops each silver halide layer and dye images, formed as a result of development, diffuse to the image-receiving layer to provide a positive, right-reading image which is viewed through the transparent support on the opaque reflecting layer background. For further details concerning the format of this particular integral film unit, reference is made to the above-mentioned Canadian Pat. No. 928,559.

Still other useful integral formats in which this invention can be employed are described in U.S. Pat. Nos. 3,415,644; 3,415,645; 3,415,646; 3,647,437 and 3,635,707. In most of these formats, a photosensitive silver halide emulsion is coated on an opaque support and a dye image-receiving layer is located on a separate transparent support superposed over the layer outermost from the opaque support. In addition, this transparent support also contains a neutralizing layer and a timing layer underneath the dye image-receiving layer.

Another embodiment of the invention uses the image-reversing technique disclosed in British Pat. No. 904,364, page 19, lines 1 through 41. In this process, the dye-releasing compounds are used in combination with physical development nuclei in a nuclei layer contiguous to the photosensitive silver halide negative emulsion layer. The film unit contains a silver halide solvent, preferably in a rupturable container with the alkaline processing composition.

A process in accordance with our invention for increasing the stability to light exposure of a dye which is released from a redox dye-releasing material comprises:

(a) imagewise-exposing a photosensitive element comprising a support having thereon at least one silver halide emulsion layer having associated therewith a redox dye-releasing material, the dye which is releasable from the material having an initial stability to light exposure;

(b) treating the element with an alkaline processing composition in the presence of a silver halide developing agent to effect development of each of the exposed silver halide emulsion layers;

(c) the redox dye-releasing material then releasing a diffusible dye imagewise as a function of the development of each of the silver halide emulsion layers; and (d) contacting the imagewise distribution of the dye with a zinc salt to cause the dye to have an increased stability to light exposure.

The film unit or assemblage of the present invention is used to produce positive images in single or multicolors. In a three-color system, each silver halide emulsion layer of the film assembly will have associated therewith an RDR which possesses a predominant spectral absorption within the region of the visible spectrum to which said silver halide emulsion is sensitive, i.e., the blue-sensitive silver halide emulsion layer will have a yellow RDR associated therewith, the green-sensitive silver halide emulsion layer will have a magenta RDR associated therewith and the red-sensitive silver halide emulsion layer will have a cyan RDR associated therewith. The RDR associated with each silver halide emulsion layer is contained either in the silver halide emulsion layer itself or in a layer contiguous to the silver halide emulsion layer, i.e., the RDR can be coated in a separate layer underneath the silver halide emulsion layer with respect to the exposure direction. In a preferred embodiment of our invention, the zinc salt is located in the RDR layer, since it is easy to incorporate in this layer which has fewer components than some of the other layers.

The concentration of the RDR material that is employed in the present invention can be varied over a wide range, depending upon the particular compound employed and the results desired. For example, the RDR material coated in a layer at a concentration of 0.1 to 3 g/m$^2$ has been found to be useful. The RDR material is usually dispersed in a hydrophilic film forming natural material or synthetic polymer, such as gelatin, polyvinyl alcohol, etc, which is adapted to be permeated by aqueous alkaline processing composition.

A variety of silver halide developing agents are useful in this invention. Specific examples of developers or electron transfer agents (ETA's) useful in this invention include hydroquinone compounds, such as hydroquinone, 2,5-dichlorohydroquinone or 2-chlorohydroquinone; aminophenol compounds, such as 4-aminophenol, N-methylaminophenol, N,N-dimethylaminophenol, 3-methyl-4-aminophenol or 3,5-dibromoaminophenol; catechol compounds, such as catechol, 4-cyclohexylcatechol, 3-methoxycatechol, or 4-(N-octadecylamino)-catechol; or phenylenediamine compounds such as N,N,N',N'-tetramethyl-p-phenylenediamine. In highly preferred embodiments, the ETA is a 3-pyrazolidinone compound, such as 1-phenyl-3-pyrazolidinone (Phenidone), 1-phenyl-4,4-dimethyl-3-pyrazolidinone (Dimezone), 4-hydroxymethyl-4-methyl-1-phenyl-3-pyrazolidinone, 4-hydroxymethyl-4-methyl-1-p-tolyl-3-pyrazolidinone, 4-hydroxymethyl-4-methyl-1-(3,4-dimethylphenyl)-3-pyrazolidinone, 1-m-tolyl-3-pyrazolidinone, 1-p-tolyl-3-pyrazolidinone, 1-phenyl-4-methyl-3-pyrazolidinone, 1-phenyl-5-methyl-3-pyrazolidinone, 1-phenyl-4,4-dihydroxymethyl-3-pyrazolidinone, 1,4-di-methyl-3-pyrazolidinone, 4-methyl-3-pyrazolidinone, 4,4-dimethyl-3-pyrazolidinone, 1-(3-chlorophenyl)-4-methyl-3-pyrazolidinone, 1-(4-chlorophenyl)-4-methyl-3-pyrazolidinone, 1-(3-chlorophenyl)-3-pyrazolidinone, 1-(4-chlorophenyl)-3-pyrazolidinone, 1-(4-tolyl)-4-methyl-3-pyrazolidinone, 1-(2-tolyl)-4-methyl-3-pyrazolidinone, 1-(4-tolyl)-3-pyrazolidinone, 1-(3-tolyl)-3-pyrazolidinone, 1-(3-tolyl)-4,4-dimethyl-3-pyrazolidinone, 1-(2-trifluoroethyl)-4,4-dimethyl-3-pyrazolidinone or 5-methyl-3-pyrazolidinone. A combination of different ETA's, such as those disclosed in U.S. Pat. No. 3,039,869, can also be employed. These ETA's are employed in the liquid processing composition or contained, at least in part, in any layer or layers of the photographic element or film assemblage to be activated by the alkaline processing composition, such as in the silver halide emulsion layers, the dye image-providing material layers, interlayers, image-receiving layer, etc.

In our invention, RDR materials can be used which produce diffusible dye images as a function of development, either conventional negative-working or direct-positive silver halide emulsions are employed. If the silver halide emulsion employed is a direct-positive silver halide emulsion, such as an internal image emulsion designed for use in the internal image reversal process, or a fogged, direct-positive emulsion such as a solarizing emulsion, which is developable in unexposed areas, a positive image can be obtained on the dye image-receiving layer by using ballasted, redox dye-releasers. After exposure of the film assemblage or unit, the alkaline processing composition permeates the various layers to initiate development of the exposed photosensitive silver halide emulsion layers. The developing agent present in the film unit develops each of the silver halide emulsion layers in the unexposed areas (since the silver halide emulsions are direct-positive ones), thus causing the developing agent to become oxidized imagewise corresponding to the unexposed areas of the direct-positive silver halide emulsion layers. The oxidized developing agent then cross-oxidizes the RDR compounds and the oxidized form of the compounds then undergoes a base-initiated reaction to release the dyes imagewise as a function of the imagewise exposure of each of the silver halide emulsion layers. At least a portion of the imagewise distributions of diffusible dyes diffuse to the image-receiving layer to form a positive image of the original subject. After being contacted by the alkaline processing composition, a neutralizing layer in the film unit or image-receiving unit lowers the pH of the film unit or image receiver to stabilize the image.

Internal image silver halide emulsions useful in this invention are described more fully in the November, 1976 edition of *Research Disclosure,* pages 76 through 79, the disclosure of which is hereby incorporated by reference.

The various silver halide emulsion layers of a color film assembly employed in this invention are disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that is transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

The rupturable container employed in certain embodiments of this invention is disclosed in U.S. Pat. Nos. 2,543,181; 2,643,886; 2,653,732; 2,723,051; 3,056,492; 3,056,491 and 3,152,515. In general, such containers comprise a rectangular sheet of fluid- and air-impervious material folded longitudinally upon itself to form two walls which are sealed to one another along their longitudinal and end margins to form a cavity in which processing solution is contained.

Generally speaking, except where noted otherwise, the silver halide emulsion layers employed in the invention comprise photosensitive silver halide dispersed in gelatin and are about 0.6 to 6 microns in thickness; the dye image-providing materials are dispersed in an aqueous alkaline solution-permeable polymeric binder, such as gelatin, as a separate layer about 0.2 to 7 microns in thickness; and the alkaline solution-permeable polymeric interlayers, e.g., gelatin, are about 0.2 to 5 microns in thickness. Of course, these thicknesses are approximate only and can be modified according to the product desired.

Scavengers for oxidized developing agent can be employed in various interlayers of the photographic elements of the invention. Suitable materials are disclosed on page 83 of the November 1976 edition of *Research Disclosure,* the disclosure of which is hereby incorporated by reference.

Any material is useful as the image-receiving layer in this invention, as long as the desired function of mordanting or otherwise fixing the dye images is obtained. The particular material chosen will, of course, depend upon the dye to be mordanted. Suitable materials are disclosed on pages 80 through 82 of the November 1976 edition of *Research Disclosure,* the disclosure of which is hereby incorporated by reference.

Use of a neutralizing material in the film units employed in this invention will usually increase the stability of the transferred image. Generally, the neutralizing material will effect a reduction in the pH of the image layer from about 13 or 14 to at least 11 and preferably 5 to 8 within a short time after imbibition. Suitable materials and their functioning are disclosed in pages 22 and 23 of the July 1974 edition of *Research Disclosure,* and pages 35 through 37 of the July 1975 edition of *Research Disclosure,* the disclosures of which are hereby incorporated by reference.

A timing or inert spacer layer can be employed in the practice of this invention over the neutralizing layer which "times" or controls the pH reduction as a function of the rate at which alkali diffuses through the inert spacer layer. Examples of such timing layers and their functioning are disclosed in the *Research Disclosure* articles mentioned in the paragraph above concerning neutralizing layers.

The alkaline processing composition employed in this invention is the conventional aqueous solution of an alkaline material, e.g, alkali metal hydroxides or carbonates such as sodium hydroxide, sodium carbonate or an amine such as diethylamine, preferably possessing a pH in excess of 11, and preferably containing a developing agent as described previously. In certain embodiments of our invention, the zinc salts may be contained in the processing composition, also. Suitable materials and addenda frequently added to such compositions are disclosed on pages 79 and 80 of the November, 1976 edition of *Research Disclosure,* the disclosure of which is hereby incorporated by reference.

The alkaline solution permeable, substantially opaque, light-reflective layer employed in certain embodiments of photographic film units used in this invention is described more fully in the November, 1976 edition of *Research Disclosure,* page 82, the disclosure of which is hereby incorporated by reference.

The supports for the photographic elements used in this invention can be any material, as long as it does not deleteriously affect the photographic properties of the film unit and is dimensionally stable. Typical flexible sheet materials are described on page 85 of the November, 1976 edition of *Research Disclosure,* the disclosure of which is hereby incorporated by reference.

While the invention has been described with reference to layers of silver halide emulsions and dye image-providing materials, dotwise coating, such as would be obtained using a gravure printing technique, could also be employed. In this technique, small dots of blue-, green- and red-sensitive emulsions have associated therewith, respectively, dots of yellow, magenta and cyan color-providing substances. After development, the transferred dyes would tend to fuse together into a continuous tone. In an alternative embodiment, the emulsions sensitive to each of the three primary regions of the spectrum can be disposed as a single segmented layer, e.g., as by the use of microvessels, as described in Whitmore U.S. Patent Application Ser. No. 184,714, filed Sept. 8, 1980.

The silver halide emulsions useful in this invention, both negative-working and direct-positive ones, are well known to those skilled in the art and are described in *Research Disclosure,* Volume 176, December, 1978, Item 17643, pages 22 and 23, "Emulsion preparation and types"; they are usually chemically and spectrally sensitized as described on page 23, "Chemical sensitization", and "Spectral sensitization and desensitization", of the above article; they are optionally protected against the production of fog and stabilized against loss of sensitivity during keeping by employing the materials described on pages 24 and 25, "Antifoggants and stabilizers", of the above article; they usually contain hardeners and coating aids as described on page 26, "Hardeners", and pages 26 and 27, "Coating aids", of the above article; they and other layers in the photographic elements used in this invention usually contain plasticizers, vehicles and filter dyes described on page 27, "Plasticizers and lubricants"; page 26, "Vehicles and vehicle extenders"; and pages 25 and 26, "Absorbing and scattering materials", of the above article; they and other layers in the photographic elements used in this invention can contain addenda which are incorporated by using the procedures described on page 27, "Methods of addition", of the above article; and they are usually coated and dried by using the various techniques described on pages 27 and 28, "Coating and drying procedures", of the above article, the disclosures of which are hereby incorporated by reference.

The term "nondiffusing" used herein has the meaning commonly applied to the term in photography and denotes materials that for all practical purposes do not migrate or wander through organic colloid layers, such as gelatin, in the photographic elements of the invention in an alkaline medium and preferably when processed in a medium having a pH of 11 or greater. The same meaning is to be attached to the term "immobile". The term "diffusible" as applied to the materials of this invention has the converse meaning and denotes materials having the property of diffusing effectively through the colloid layers of the photographic elements in an alkaline medium. "Mobile" has the same meaning as "diffusible".

The term "associated therewith" as used herein is intended to mean that the materials can be in either the same or different layers, so long as the materials are accessible to one another.

The following examples are provided to further illustrate the invention.

EXAMPLE 1

Zinc Sulfate in Pod

Comparison Tests

A cover sheet was prepared by coating the following layers, in the order recited, on a poly(ethylene terephthalate) film support:

(1) an acid layer comprising poly(n-butyl acrylate-co-acrylic acid), (30:70 weight ratio equivalent to 140 meq. acid/$m^2$); and (2) a timing layer comprising 3.2 g/$m^2$ of a 1:1 physical mixture by weight of poly(acrylonitrile-co-vinylidene chloride-co-acrylic acid latex) (molar ratio of 14/79/7) and a lactone polymer, partially hydrolyzed and 1-butanol transesterified poly(vinyl acetate-co-maleic anhydride), ratio of acid/butyl ester 15/85.

An integral imaging-receiver (IIR) element was prepared by coating the following layers in the order recited on a transparent poly(ethylene terephthalate) film support. Quantities are parenthetically given in grams per square meter, unless otherwise stated.

(1) image-receiving layer of poly(styrene-co-1-vinylimidazole-co-3-benzyl-1-vinylimidazolium chloride (50/40/10 weight ratio) latex mordant (4.8) and gelatin (2.3);

(2) reflecting layer of titanium dioxide (16.2) and gelatin (2.6);

(3) opaque layer of carbon black (1.9), gelatin (1.2), oxidized developer scavenger 2-(2-octadecyl)-5-sulfohydroquinone potassium salt (0.02) and cyan RDR A (0.02) dispersed in N-n-butylacetanilide;

(4) cyan dye-providing layer of gelatin (0.65) and cyan RDR B (0.38) dispersed in N-n-butylacetanilide;

(5) red-sensitive, direct-positive silver bromide emulsion (0.91 silver), gelatin (0.91), Nucleating Agent A (150 mg/Ag mole), 2-(2-octadecyl)-5-sulfohydroquinone potassium salt (16 g/Ag mole) and Nucleating Agent B (1.7 mg/Ag mole);

(6) interlayer of gelatin (1.2) and 2,5-di-sec-dodecylhydroquinone (0.97);

(7) magenta dye-providing layer of magenta RDR C (0.38) dispersed in diethyllauramide) and gelatin (0.65);

(8) green-sensitive, direct-positive silver bromide emulsion (0.91 silver), gelatin (0.91), Nucleating Agent A (150 mg/Ag mole), Nucleating Agent B (0.5 mg/Ag mole), and 2-(2-octadecyl)-5-sulfohydroquinone potassium salt (16 g/Ag mole);

(9) interlayer of gelatin (1.2) and 2,5-di-sec-dodecylhydroquinone (0.97);

(10) yellow dye-providing layer of yellow RDR D (0.65) dispersed in di-n-butyl phthalate and gelatin (0.86);

(11) blue-sensitive, direct-positive silver bromide emulsion (0.91 silver), gelatin (0.91), Nucleating Agent A (90 mg/Ag mole), Nucleating Agent B (6 mg/Ag mole), and 2-(2-octadecyl)-5-sulfohydroquinone potassium salt (16 g/Ag mole); and

(12) overcoat layer of gelatin (0.89), 2,5-di-sec-dodecylhydroquinone (0.11), and t-butylhydroquinone monoacetate (0.01).

The direct-positive emulsions are approximately 0.8μ monodispersed, octahedral, internal image silver bromide emulsions, as described in U.S. Pat. No. 3,923,513.

CYAN RDR A

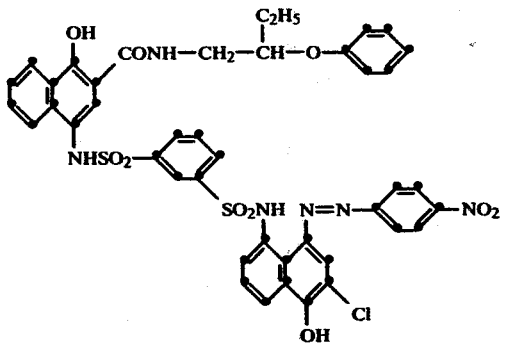

CYAN RDR B

-continued

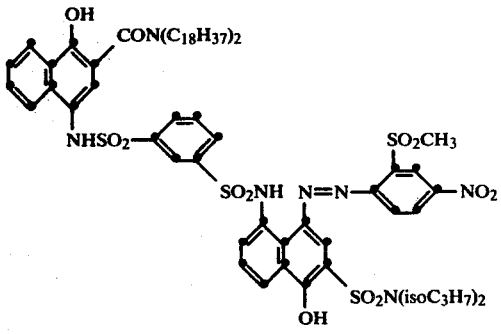

MAGENTA RDR C

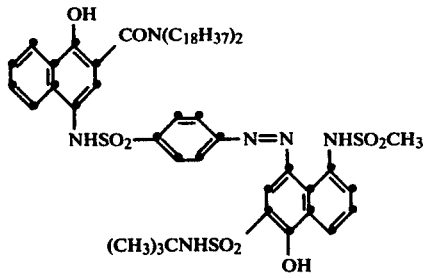

YELLOW RDR D

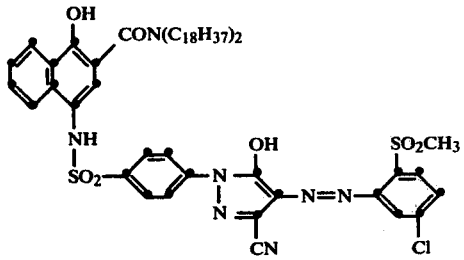

Nucleating Agent A

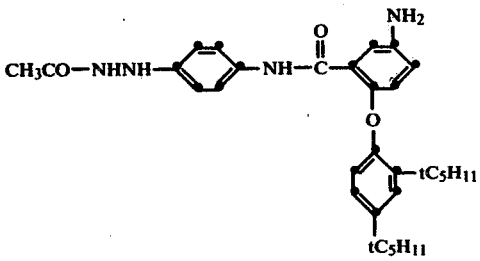

Nucleating Agent B

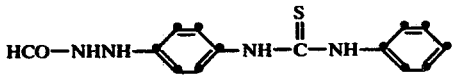

Samples of the IIR were exposed in a sensitometer through a graduated density test object to yield a neutral at a Status A density of 1.0. The exposed samples were then processed at 21° C. by rupturing a pod containing the viscous processing composition described below between the IIR and the cover sheet described above, by using a pair of juxtaposed rollers to provide a processing gap of about 65 μm.

The processing composition (A) was as follows:

3.4 g sodium hydroxide
46.8 g potassium hydroxide
7 g 4-methyl-4-hydroxymethyl-1-p-tolyl-3-pyrazolidinone
1.5 g 1,4-cyclohexanedimethanol
4 g 5-methylbenzotriazole
1 g sodium sulfite
8.8 g Tamol SN® dispersant
6 g potassium fluoride
66.8 g carboxymethylcellulose
171 g carbon
0.2 g t-butylhydroquinone water to 1 liter The above procedure was repeated, with the exception that portions of the processing composition had added to them: (B) 7.5 g/l $Cu(NO_3)_2$, (C) 4.5 g/l $Co(NO_3)_2.6H_2O$, (D) 7.5 g/l $ZnSO_4.7H_2O$ and (E) 15 g/l $ZnSO_4.7H_2O$.

After processing, one portion of each test object is masked with opaque paper to serve as a dark control, the remainder being left ummasked. The test object is then subjected to light fade conditions of 50,000 LUX (measured at the surface) 35° C., 53 percent relative humidity for four days. The difference (ΔD) in Status A density between the masked (dark) and unmasked (light-exposed) area at an original neutral image density near 1.0 was measured, and the following results were obtained:

| | Processing Composition | ΔD 4-Day Light Fade Test R | G | B |
|---|---|---|---|---|
| (A) | Control | −0.20 | −0.03 | 0.0 |
| (B) | (A) + 7.5 g/l $Cu(NO_3)_2$ | −0.18 | 0.0 | 0.0 |
| (C) | (A) + 4.5 g/l $Co(NO_3)_2.6H_2O$ | −0.14 | −0.07 | +0.02 |
| (D) | (A) + 7.5 g/l $ZnSO_4.7H_2O$ | −0.08 | 0.0 | +0.02 |
| (E) | (A) + 15 g/l $ZnSO_4.7H_2O$ | −0.08 | −0.05 | −0.04 |

The above results indicate that use of zinc sulfate in the processing composition (D and E) in accordance with our invention is of benefit in improving light stability, primarily for the cyan dye. While the use of copper and cobalt salts (B and C) have a slight effect, they are not nearly as effective as the zinc salts of our invention.

EXAMPLE 2

Zinc Oxide and Zinc Sulfate in Incubated Pod

A cover sheet was prepared by coating the following layers, in the order recited, on a poly(ethylene terephthalate) film support:

(1) an acid layer comprising poly(n-butyl acrylate-co-acrylic acid), (30:70 weight ratio equivalent to 140 meq. acid/$m^2$);

(2) a timing layer comprising 2.6 g/$m^2$ of a 1:1 physical mixture by weight of poly(acrylonitrile-co-vinylidene chloride-co-acrylic acid latex) (molar ratio of 14/79/7) and a lactone polymer, partially hydrolyzed and 1-butanol transesterified poly(vinyl acetate-co-maleic anhydride), ratio of acid/butyl ester 15/85, t-butylhydroquinone monoacetate (0.04 g/$m^2$) and 5-(2-cyanoethylthio)-1-phenyltetrazole (0.11 g/$m^2$, and (3) overcoat layer of gelatin (3.8 g/$m^2$).

An IIR element was prepared similar to that of Example 1, except that in layer 12, no t-butylhydoquinone monoacetate was present.

A processing composition was prepared similar to the control processing composition of Example 1 except that no t-butylhydroquinone was present, the 4-methyl-4-hydroxymethyl-1-p-tolyl-3-pyrazolidone was present in a concentration of 15 g/l and the 5-methylbenzotriazole was present in a concentration of 5 g/l. To portions of this composition were added: 4.2 g/l ZnO, 8.5 g/l ZnO and 25 g/l $ZnSo_4.7H_2O$. Pods containing the above composition were incubated for one month at −17° C. and 48° C. Using the above cover sheet, portions of the above IIR element were then processed and tested as in Example 1, with the following results:

| Processing Composition | ΔD 4-Day Light Fade Test: 1 Month @ −17° C. R | G | B | 1 Month @ 48° C. R | G | B |
|---|---|---|---|---|---|---|
| (a) Control | −0.33 | −0.03 | −0.04 | −0.38 | −0.04 | −0.05 |
| (b) (a) + 4.2 g/l ZnO | −0.14 | −0.08 | −0.04 | −0.13 | −0.06 | −0.03 |
| (c) (a) + 8.5 g/l ZnO | −0.11 | −0.07 | −0.07 | −0.09 | −0.07 | −0.06 |
| (d) (a) + 25 g/l $ZnSO_4.7H_2O$ | −0.13 | −0.14 | −0.06 | −0.07 | −0.11 | −0.06 |

The above results indicate that the use of zinc salts in the processing composition is of benefit in improving the light stability, particularly for the cyan dye.

EXAMPLE 3

Zinc Acetate in Cover Sheet (A) A control cover sheet was prepared by coating the following layers, in the order recited, on a poly(ethylene terephthalate) film support:

(1) an acid layer comprising poly(n-butyl acrylate-co-acrylic acid), (30:70 weight ratio equivalent to 140 meq. acid/$m^2$);

(2) a timing layer comprising 5.4 g/$m^2$ of a 1:1 physical mixture by weight of poly(acrylonitrile-co-vinylidene chloride-co-acrylic acid latex) (molar ratio of 14/79/7) and a lactone polymer, partially hydrolyzed and 1-butanol transesterified poly(vinyl acetate-co-maleic anhydride), ratio of acid/butyl ester 15/85, t-butylhydroquinone monoacetate (0.22 g/$m^2$) and 5-(2-cyanoethylthio)-1-phenyltetrazole (0.11 g/$m^2$), and (3) overcoat layer of gelatin (3.8 g/$m^2$).

(B) Another cover sheet was prepared similar to (A), except that overcoat layer 3 contained 0.54 g/$m^2$ $Zn(O_2CCH_3)_2$.

An IIR was prepared similar to that of Example 1.

A processing composition was prepared similar to the control processing composition of Example 1, except that no t-butylhydroquinone was present, the 4-methyl-4-hydroxymethyl-1-p-tolyl-3-pyrazolone was present in a concentration of 10 g/l and the 1,4-cyclohexanedimethanol was present in a concentration of 3 g/l.

Portions of the above IIR element and cover sheets were then processed and tested as in Example 1, with the following results:

| | Cover Sheet | ΔD 4-Day Light Fade Test R | G | B |
|---|---|---|---|---|
| (A) | Control | −0.26 | +0.10 | +0.09 |
| (B) | (A) + 0.54 g/$m^2$ $Zn(O_2CCH_3)_2$ in | | | |

-continued

| Cover Sheet | ΔD 4-Day Light Fade Test R | G | B |
|---|---|---|---|
| Overcoat Layer | −0.13 | −0.01 | +0.01 |

The above results indicate that the use of zinc acetate in a cover sheet is of benefit in improving the light stability of the dyes.

EXAMPLE 4

Zinc Acetate in Cover Sheet with Different IIR's

A cover sheet was prepared by coating the following layers, in the order recited, on a poly(ethylene terephthalate) film support:

(1) an acid layer comprising poly(n-butyl acrylate-co-acrylic acid), (30:70 weight ratio equivalent to 140 meq. acid/$m^2$);

(2) a timing layer comprising 4.3 g/$m^2$ of a 1:1 physical mixture by weight of poly(acrylonitrile-co-vinylidene chloride-co-acrylic acid latex) (molar ratio of 14/79/7) and a lactone polymer, partially hydrolyzed and 1-butanol transesterified poly(vinyl acetate-co-maleic anhydride), ratio of acid/butyl ester 15/85, t-butylhydroquinone monoacetate (0.22 g/$m^2$) and 5-(2-cyanoethylthio)-1-phenyltetrazole (0.11 g/$m^2$), and (3) overcoat layer of gelatin (3.8 g/$m^2$).

Cover sheets similar to the control cover sheet were prepared, but with 0.27, 1.19 and 2.2 g/$m^2$ of zinc acetate in layer 3.

An IIR (A) was prepared similar to that of Example 1. Another IIR (B) was prepared similar to that of Example 1, except that in layer 1, the mordant was poly(divinylbenzene-co-styrene-co-N-benzyl-N,N-dimethyl-N-vinyl-benzyl)ammonium sulfate (1/49.5/49.5) latex at 2.3 g/$m^2$.

A processing composition was prepared similar to that of Example 3.

Portions of the IIR's and cover sheets were then processed and tested as in Example 1, with the following results:

| | Cover Sheet | ΔD 4-Day Light Fade Test (Red) IIR (A) | IIR (B) |
|---|---|---|---|
| (a) | Control | −0.32 | −0.29 |
| (b) | (a) + 0.27 g/$m^2$ zinc acetate | −0.20 | −0.28 |
| (c) | (a) + 1.19 g/$m^2$ zinc acetate | −0.10 | −0.18 |
| (d) | (a) + 2.2 g/$m^2$ zinc acetate | −0.06 | −0.14 |

The above results indicate that the use of zinc acetate in a cover sheet in increasing concentrations gives progressive improvement in light stability of the cyan dye. The improvement was observed in IIR's with different mordants.

EXAMPLE 5

Use of ZnO in Various Layers of an IIR

A cover sheet similar to that of Example 3 was prepared.

A control IIR was prepared similar to that of Example 1, except that:

(1) in layer 4, the gelatin concentration was (0.86) and the cyan RDR B concentration was (0.43);

(2) in layer 5, the silver concentration was (1.4), no Nucleating Agent B was present, the gelatin concentration was (1.4), and 0.5 mg/Ag mole of

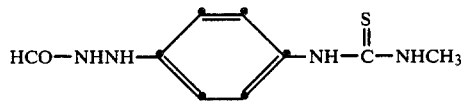

was present;

(3) in layer 6, the gelatin concentration was (1.6) and the 2,5-di-sec-dodecylhydroquinone concentration was (1.1);

(4) in layer 7, the magenta RDR C concentration was (0.43) and the gelatin concentration was (0.86);

(5) in layer 8, the silver concentration was (1.4), the Nucleating Agent A concentration was 14 mg/Ag mole, no Nucleating Agent B was present, the gelatin concentration was (1.4), and 0.3 mg/Ag mole of

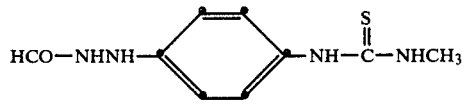

was present;

(6) in layer 9, the gelatin concentration was (1.6) and the 2,5-di-sec-dodecylhydroquinone concentration was (1.1);

(7) in layer 11, the silver concentration was (1.4), the Nucleating Agent A concentration was 12 mg/Ag mole, no Nucleating Agent B was present, the gelatin concentration was (1.4), 0.4 mg/Ag mole of

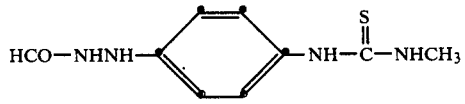

was present, and t-butylhydoquinone monoacetate (0.02) was present; and (8) in layer 12, 5-(2-cyanoethylthio-1-phenyl tetrazole (0.005) was present.

Additional similar IIR's were prepared, but with ZnO at a concentration of 0.27 g/$m^2$ incorporated at various locations identified in the table below.

A processing composition similar to that of Example 2 was prepared.

Using the above cover sheet and processing composition, the above IIR's were then processed and tested as in Example 1, with the following results:

| IIR with ZnO (0.27 g/$m^2$) | ΔD 4-Day Light Fade Test R | G | B |
|---|---|---|---|
| None | −0.46 | +0.13 | +0.01 |
| In Layer 4 | −0.20 | −0.01 | −0.03 |
| In Layer 6 | −0.12 | +0.03 | +0.01 |
| In Layer 7 | −0.14 | +0.02 | 0 |
| In Layer 9 | −0.13 | 0 | −0.01 |
| In Layer 10 | −0.18 | −0.02 | −0.05 |
| In Layer 12 | −0.19 | −0.01 | −0.03 |

The above results indicate that the use of zinc oxide in various locations in an IIR is of benefit in improving cyan dye light stability.

EXAMPLE 6

Use in ZnO in RDR layer with Different Cyan RDR's

A cover sheet similar to that of Example 5 was prepared.

(A) A control IIR was prepared similar to that of Example 5, except that in layer 5, the concentration of the additional nucleating agent was changed from 0.5 mg/Ag mole to 0.8 mg/Ag mole.

(B) Another IIR was prepared similar to the control (A), except that layer 10 also contained 0.27 g/m$^2$ of ZnO.

(C) Another IIR was prepared similar to (B), except that in layer 4, the following cyan RDR C was used instead of cyan RDR B, and was dispersed in diethyllauramide, instead of N-n-butylacetanilide:

CYAN RDR C

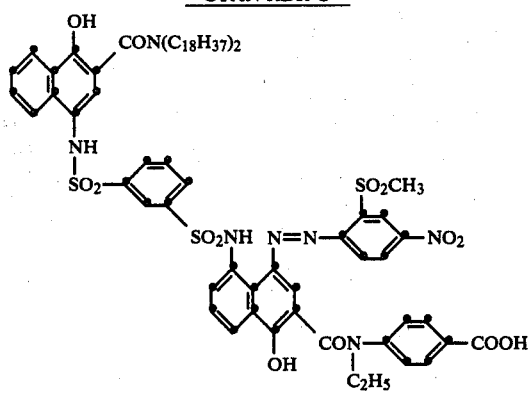

A processing composition similar to that of Example 5 was prepared.

Using the above cover sheet and processing composition, the above IIR's were then processed and tested as in Example 1, with the following results:

| IIR | ZnO in Layer 10 (g/m$^2$) | Cyan RDR in Layer 4 | ΔD 4-Day Light Fade Test (Red) |
|---|---|---|---|
| A | None | Cyan RDR B | −0.51 |
| B | 0.27 | Cyan RDR B | −0.16 |
| C | 0.27 | Cyan RDR C | −0.12 |

The above results indicate that the use of zinc oxide in the yellow RDR layer gives improved light stability with two different cyan RDR's.

The invention has been described in detail with particular reference to preferred embodiments thereof, but it will be understood that variations and modifications can be effected within the spirit and scope of the invention.

What is claimed is:

1. In a photosensitive element comprising a support having thereon at least one silver halide emulsion layer having associated therewith a redox dye-releasing material, the improvement wherein said element contains a soluble zinc salt in such a location and concentration that (a) it will be diffusible in said element during processing, and (b) the dye which is released from said redox dye-releasing material during said processing will have an increased stability to light exposure, said zinc salt being present in a concentration of at least about 10 mg/m$^2$ of element.

2. The element of claim 1 wherein said zinc salt is zinc oxide.

3. The element of claim 1 wherein said zinc salt is present in a concentration of about 10 to about 1200 mg/m$^2$ of element.

4. The element of claim 1 wherein said redox dye-releasing material is located in a separate layer from said silver halide emulsion layer and said zinc salt is located in said redox dye-releasing layer.

5. In a photosensitive element comprising a red-sensitive silver halide emulsion layer having a cyan redox dye-releaser associated therewith, a green-sensitive silver halide emulsion layer having a magenta redox dye-releaser associated therewith, and a blue-sensitive silver halide emulsion layer having a yellow redox dye-releaser associated therewith, the improvement wherein said photosensitive element contains a soluble zinc salt in such a location and concentration that (a) it will be diffusible in said element during processing, and (b) at least one said dye which is released from one said dye-releaser during said processing will have an increased stability to light exposure, said zinc salt being present in a concentration of at least about 10 mg/m$^2$ of element.

6. The photographic element of claim 5 wherein said zinc salt is zinc oxide.

7. In a photographic assemblage comprising:

(a) a photosensitive element comprising a support having thereon at least one silver halide emulsion layer having associated therewith a redox dye-releasing material; and (b) a dye image-receiving layer; the improvement wherein said photosensitive element contains a soluble zinc salt in such a location and concentration that (a) it will be diffusible in said element during processing, and (b) the dye which is released from said redox dye-releasing material during said processing will have an increased stability to light exposure, said zinc salt being present in a concentration of at least about 10 mg/m$^2$ of element.

8. The photographic assemblage of claim 7 wherein said zinc salt is zinc oxide.

9. In a photographic assemblage comprising:

(a) a photosensitive element comprising a support having thereon at least one silver halide emulsion layer having associated therewith a redox dye-releasing material;

(b) a dye image-receiving layer; and (c) an alkaline processing composition and means containing same for discharge within said assemblage; the improvement wherein either said alkaline processing composition contains a soluble zinc salt or said element contains a soluble zinc salt in such a location and concentration that (a) said zinc salt will be diffusible in said element during processing, and (b) the dye which is released from said redox dye-releasing material during said processing will have an increased stability to light exposure, said zinc salt being present to provide a coverage of at least about 10 mg/m$^2$ of element.

10. The photographic assemblage of claim 9 wherein said zinc salt is zinc oxide.

11. The photographic assemblage of claim 9 wherein said zinc salt is present in a concentration of about 10 to about 1200 mg/m$^2$ of element.

12. The photographic assemblage of claim 9 wherein said redox dye-releasing material is located in a separate layer from said silver halide emulsion layer and said zinc salt is located in said redox dye-releasing layer.

13. The photographic assemblage of claim 9 wherein said zinc salt is located in said processing composition.

14. The photographic assemblage of claim 13 wherein said zinc salt is zinc oxide.

15. In a photographic assemblage comprising:

(a) a photosensitive element comprising a red-sensitive silver halide emulsion layer having a cyan redox dye-releaser associated therewith, a green-sensitive silver halide emulsion layer having a magenta redox dye-releaser associated therewith, and a blue-sensitive silver halide emulsion layer having a yellow redox dye-releaser associated therewith;

(b) a dye image-receiving layer; and (c) an alkaline processing composition and means containing same for discharge within said assemblage; the improvement wherein either said alkaline processing composition contains a soluble zinc salt or said element contains a soluble zinc salt in such a location and concentration that (a) said zinc salt will be diffusible in said element during processing, and (b) at least one said dye which is released from one said dye-releaser during said processing will have an increased stability to light exposure, said zinc salt being present to provide a coverage of at least about 10 mg/m$^2$ of element.

16. The photographic assemblage of claim 15 wherein said zinc salt is zinc oxide.

17. The photographic assemblage of claim 15 wherein:

(a) said dye image-receiving layer is located in said photosensitive element between said support and said silver halide emulsion layer;

(b) said assemblage also includes a transparent cover sheet over the layer outermost from said support; and (c) said zinc salt is located in the photosensitive portion of said photosensitive element.

18. The photographic assemblage of claim 17 wherein said cover sheet has thereon, in sequence, a neutralizing layer and a timing layer.

19. The photographic assemblage of claim 18 wherein said discharging means is a rupturable container containing said alkaline processing composition and an opacifying agent, said container being so positioned during processing of said assemblage that a compressive force applied to said container will effect a discharge of the container's contents between said transparent sheet and the layer outermost from said support.

20. The photographic assemblage of claim 15 wherein said support having thereon said photosensitive silver halide emulsion layer is opaque and said dye image-receiving layer is located on a separate transparent support superposed over the layer outermost from said opaque support.

21. The photographic assemblage of claim 20 wherein said transparent support has thereon, in sequence, a neutralizing layer, a timing layer and said dye image-receiving layer.

22. The photographic assemblage of claim 15 wherein said dye which is released from said dye-releaser which has an increased stability to light exposure is a cyan azo dye.

23. In an integral photographic assemblage comprising:

(a) a photosensitive element comprising a transparent support having thereon the following layers in sequence: a dye image-receiving layer, an alkaline solution-permeable, light-reflective layer, an alkaline solution-permeable, opaque layer, and a photosensitive portion comprising a red-sensitive silver halide emulsion layer having a cyan redox dye-releaser associated therewith, a green-sensitive silver halide emulsion layer having a magenta redox dye-releaser associated therewith, and a blue-sensitive silver halide emulsion layer having a yellow redox dye-releaser associated therewith;

(b) a transparent sheet superposed over said blue-sensitive silver halide emulsion layer and comprising a transparent support having thereon, in sequence, a neutralizing layer and a timing layer; and (c) a rupturable container containing an alkaline processing composition and an opacifying agent which is so positioned during processing of said assemblage that a compressive force applied to said container will effect a discharge of the container's contents between said transparent sheet and said blue-sensitive silver halide emulsion layer; said assemblage containing a silver halide developing agent; the improvement wherein said rupturable container or said photosensitive portion of said photosensitive element or said transparent sheet contains a soluble zinc salt in such a location and concentration that (a) said zinc salt will be diffusible in said element during processing, and (b) at least one said dye which is released from one said dye-releaser during said processing will have an increased stability to light exposure, said zinc salt being present to provide a coverage of at least about 10 mg/m$^2$ of element.

24. The photographic assemblage of claim 23 wherein said zinc salt is zinc oxide.

25. The photographic assemblage of claim 23 wherein said zinc salt is located in said rupturable container.

26. The photographic assemblage of claim 23 wherein each of said redox dye-releaser is located in a separate layer from each said silver halide emulsion layer and said zinc salt is located in said yellow redox dye-releaser layer.

27. The photographic assemblage of claim 26 wherein said zinc salt is zinc oxide.

28. The photographic assemblage of claim 23 wherein said zinc salt is located on said transparent sheet.

29. The photographic assemblage of claim 28 wherein said zinc salt is zinc oxide.

30. The photographic assemblage of claim 23 wherein said dye which is released from said dye-releaser which will have an increased stability to light exposure is a cyan azo dye.

31. A process for increasing the stability to light exposure of a dye which is released from a redox dye-releasing material comprising:

(a) imagewise-exposing a photosensitive element comprising a support having thereon at least one silver halide emulsion layer having associated therewith a redox dye-releasing material, the dye which is releasable from said material having an initial stability to light exposure;

(b) treating said element with an alkaline processing composition in the presence of a silver halide developing agent to effect development of each of the exposed silver halide emulsion layers;

(c) said redox dye-releasing material then releasing a diffusible dye imagewise as a function of said development of each of said silver halide emulsion layers; and (d) contacting said imagewise distribution of said dye with a soluble zinc salt to cause said dye to have an increased stability to light exposure, said zinc salt being present to provide a coverage of at least about 10 mg/m$^2$ of element.

32. The process of claim 31 wherein said zinc salt is zinc oxide.

* * * * *